US005813689A

United States Patent [19]

Mansure

[11] Patent Number: 5,813,689

[45] Date of Patent: Sep. 29, 1998

[54] BINDING ASSEMBLY FOR A SNOW BOARD

[75] Inventor: Brian S. Mansure, Orem, Utah

[73] Assignee: Brigham Young University, Provo, Utah

[21] Appl. No.: 857,414

[22] Filed: May 16, 1997

Related U.S. Application Data

[60] Provisional application No. 60/017,898 May 17, 1996.

[51] Int. Cl.[6] ..... A63C 9/02

[52] U.S. Cl. ..... 280/607; 280/618; 280/14.2

[58] Field of Search ..... 280/607, 617, 280/618, 626, 14.2

[56] References Cited

U.S. PATENT DOCUMENTS

| | | | |
|---|---|---|---|
| 68,150 | 8/1867 | Barker . | |
| 83,760 | 11/1868 | Carkeet . | |
| 2,593,974 | 4/1952 | Brown | 280/21 |
| 3,088,748 | 5/1963 | Malmo | 280/12 |
| 4,027,896 | 6/1977 | Frechin et al. | 280/618 |
| 4,065,151 | 12/1977 | Weinstein et al. | 280/618 |
| 4,152,009 | 5/1979 | Schmid | 280/614 |
| 4,175,759 | 11/1979 | Strunk | 280/16 |
| 4,593,927 | 6/1986 | Salomon et al. | 280/615 |
| 4,823,858 | 4/1989 | Perutz | 160/135 |
| 4,871,337 | 10/1989 | Harris | 441/74 |
| 4,964,649 | 10/1990 | Chamberlin | 280/618 |
| 4,974,867 | 12/1990 | Rullier et al. | 280/607 |
| 4,979,761 | 12/1990 | Rohlin | 280/607 |
| 5,028,068 | 7/1991 | Donovan | 280/618 |
| 5,044,656 | 9/1991 | Peyre | 280/618 |
| 5,085,455 | 2/1992 | Bogner et al. | 280/618 |
| 5,129,668 | 7/1992 | Hecht | 280/618 X |
| 5,190,311 | 3/1993 | Carpenter et al. | 280/618 |
| 5,213,356 | 5/1993 | Rohrmoser | 280/618 X |
| 5,277,635 | 1/1994 | Gillis | 441/74 |
| 5,354,088 | 10/1994 | Vetter et al. | 280/618 |
| 5,417,443 | 5/1995 | Blattner et al. | 280/14.2 |
| 5,435,080 | 7/1995 | Meiselman | 36/117 |
| 5,499,837 | 3/1996 | Hale et al. | 280/607 |
| 5,520,406 | 5/1996 | Anderson et al. | 280/14.2 X |

OTHER PUBLICATIONS

The Magnasom Device.

*Primary Examiner*—Brian L. Johnson
*Assistant Examiner*—Michael Mar
*Attorney, Agent, or Firm*—Madson & Metcalf

[57] ABSTRACT

A binding assembly for use on a sport board. The binding assembly includes a binding plate which may be attached to the boot of a rider and a mounting plate which is attached to the board. First and second hinge assemblies pivotally attach the mounting plate to the binding plate. The first hinge assembly includes two hinge arms, each being pivotally mounted at a first end to the mounting plate about a first axis of rotation and pivotally mounted at a second end to the binding plate about a second axis of rotation. The second hinge assembly also includes two hinge arms, each being pivotally mounted at a first end to the binding plate about the first axis of rotation and pivotally mounted at a second end to the mounting plate about a second axis of rotation. Thus, the binding mechanism permits the binding plate to pivot about the first axis of rotation between a home position and a first rotated position and pivot about the second axis of rotation between the home position and a second rotated position.

39 Claims, 7 Drawing Sheets

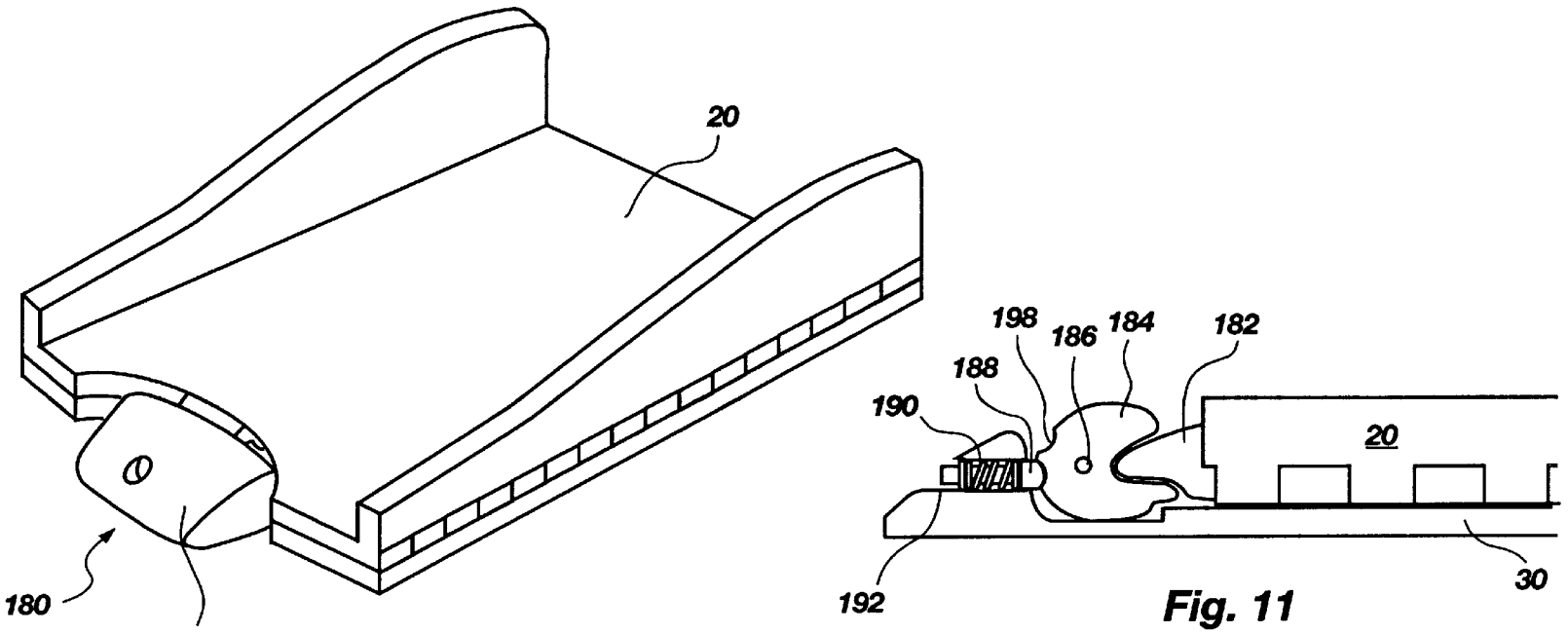
Fig. 11
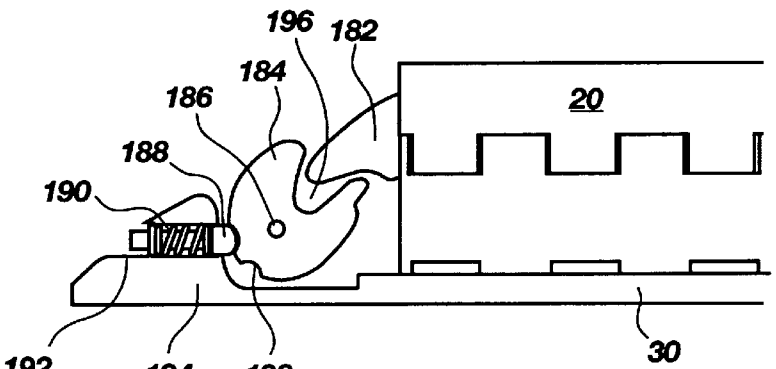
Fig. 12
Fig. 10

BINDING ASSEMBLY FOR A SNOW BOARD

BACKGROUND

1. Related Applications

This application is a continuation-in-part of and claims priority from pending U.S. provisional patent application Ser. No. 60/017,898 filed May 17, 1996 and entitled "Binding Assembly for a Snow Board."

2. The Field of the Invention

The present invention is related to an improved binding for use on a sport board. More particularly, the present invention is related to a snow board binding which permits rotation of the user's boot about two parallel axes of rotation positioned substantially along the lateral edges of the user's boot.

3. Technical Background

Sports such as surfing and skateboarding, in which a rider is positioned on a board to travel across a surface, have enjoyed popularity for many years. More recently, snow boards have been developed which provide for a similar experience. Unlike surfboards and skateboards in which the rider stands freely on the board, however, snow boards utilize bindings which affix the rider to the board by rigidly securing the rider's boots.

The inability to move the rider's boot relative to the board presents some limitations in the activities which can be conducted while riding a snow board. For example, experienced skateboarders will often rotate onto a lateral edge of one or both of their feet to facilitate the performance of tricks or other complicated maneuvers. Of course, when riding a snow board in which the rider's feet are rigidly secured to the board, such rotation is not possible.

Another significant disadvantage of the rigid binding systems utilized on snow boards is their inability to allow some form of release of the boot of the rider should the rider fall or collide with a tree or other obstacle. This leads to an increased potential for injury to the rider.

From the foregoing, it will be appreciated that it would be an advancement in the art to provide a binding assembly which could be used on a sport board, such as a snow board, which would permit movement of the rider's boot relative to the board.

It would be a further advancement if such a binding mechanism would allow for pivotal movement of the rider's boot about axes of rotation substantially along the lateral edges of the boot.

It would be an additional advancement in the art to provide such a binding assembly which would decrease the risk of injury in the event of a fall or collision while riding such a sport board.

Such a device is disclosed and claimed herein.

BRIEF SUMMARY AND OBJECTS OF THE INVENTION

The present invention is directed to a sport board assembly which includes a novel binding for securing a boot to the sport board. In the embodiments illustrated and described herein, the sport board is a snow board. However, it should be appreciated that a variety of other types of sport boards, such as skateboards and surfboards, could also utilize the present invention.

In one embodiment, the binding of the present invention comprises a binding plate which includes means for attachment of the binding plate to the boot. The binding also includes a mounting plate which is attached to the binding plate by two hinge assemblies. The binding plate also includes means for attachment of the mounting plate to the board. Such attachment means may include any conventionally known attachment mechanisms. One popular attachment mechanism involves configuring a circular, mounting orifice, having a recessed perimeter, in the mounting plate. A correspondingly sized circular disk with a flange configured on its perimeter is positioned over the mounting orifice such that when the disk is secured to the board, rotational movement of the mounting plate relative to the disk is prevented. Hence, the user may orient the angular position of the binding with respect to the board prior to rigidly securing the binding in place.

A first hinge assembly includes a first hinge arm and a second hinge arm. One end of the first hinge arm is pivotally mounted about a first axis of rotation to the mounting plate. The other end of the first hinge arm is pivotally mounted to the binding plate. Similarly, one end of the second hinge arm of the first hinge assembly is pivotally mounted about the first axis of rotation to the mounting plate and the other end is pivotally mounted to the binding plate.

In this preferred embodiment, the second hinge assembly is configured and positioned similar to the first hinge assembly. Thus, the second hinge assembly includes a first hinge arm which is pivotally mounted at one end about the first axis of rotation to the mounting plate and is pivotally mounted at the other end to the binding plate. The second hinge assembly also includes a second hinge arm which is pivotally mounted at one end to the mounting plate and is pivotally mounted at the other end about the second axis of rotation to the binding plate.

Thus, the binding plate is permitted to pivot about the first axis of rotation between a home position and a first rotated position and is further permitted to pivot about the second axis of rotation between the home position and a second rotated position.

Typically, hinge mounts are located in the mounting plate and in the binding plate and are configured to accommodate pivotal attachment to the ends of the hinge arms. The hinge mounts are positioned such that, when the binding plate is in the home position, the first hinge arm of the first hinge assembly is substantially contiguous to the corresponding first hinge arm of the second hinge assembly. Similarly, the second hinge arm of the first hinge assembly is positioned to be substantially contiguous to the corresponding second hinge arm of the second hinge assembly.

The binding plate is generally configured as a rectangular plate large enough to accommodate the "footprint" of the boot designed to be secured by the binding. In one embodiment, the first and second hinge assemblies are configured such that the first axis of rotation is substantially collinear with one of the lateral edges of the binding plate and the second axis of rotation is substantially collinear with the other of the lateral edges of the binding plate. Hence, the first and second hinge assemblies are configured such that the first and second axes of rotation are substantially parallel to each other and to the plane of the board. Nevertheless, it has been found that the first axis of rotation need not be parallel to the second axis of rotation. Thus, in an alternate embodiment, the first axis of rotation and the second axis of rotation are within the same plane, but are slightly offset from a parallel relative orientation.

In one embodiment, a protective covering is used to encase the bindings assembly. The protective covering encloses the hinges by extending between and fully encompassing the binding plate and the mounting plate. The protective covering may comprise an accordion-type bellows or a stretchable material with one or more folds therein. Ribs may be placed in the folds to better retain the shape of the protective covering and to keep the protective covering from collapsing inward where it can be caught in the hinges. With the use of the protective covering, snow and debris are prevented from accumulating between the binding plate and the mounting plate.

In an alternative embodiment wherein the binding assembly is not encased in a protective covering, the hinge mounts are each configured with a hinged side which is adjacent to the hinge arm to which it is mounted and an opposite, open side. Each hinge mount is further contoured radially inwardly, toward the hinge axis, with the contour extending from the hinged side toward the open side. Hence, any snow which accumulates in the area of the hinges will be wedged out of the hinge assemblies when the binding plate moves into the home position.

Also in this embodiment, the bottom surface of the binding plate is positioned contiguous to the top surface of the mounting plate when the binding plate is in the home position. Because of the possibility of snow collecting between the binding plate and the mounting plate when the binding plate is in one of the rotated positions, the bottom surface of the binding plate and the top surface of the mounting plate are preferably made of a low-friction material. Thus, as the mounting plate is returned to the home position, any accumulated snow will be wedged out from between the binding plate and the mounting plate. Such low-friction materials may include, for example, acetyl co-polymer, high density polyethylene, and coatings which include Teflon. For some applications, nylons may also be employed, although because nylons are less resistant to penetration by water, they are not presently preferred for a snow board application.

Additionally, in embodiments where no protective covering is used, the bottom surface of the binding plate is preferably configured to incline upwardly from a centerline extending parallel to the axes of rotation. The top surface of the mounting plate, which faces the bottom surface of the binding plate, is similarly configured to incline downwardly from the centerline. Thus, a wedge is formed between the mounting plate and the binding plate which forces contaminants, such as snow, to be pushed out from between the binding plate and the mounting plate when the binding plate is rotated from one of the rotated positions to the home position.

In embodiments employing a circular disk to mount the mounting plate to the board, a cap which is securable in the mounting orifice of the mounting plate is utilized to cover the circular disk. The cap then defines at least a portion of the top surface of the mounting plate and is configured with the inclined surfaces described above.

A lock for selectively preventing the binding plate from pivoting about at least one of the axes of rotation may also be utilized. In one embodiment, the lock comprises a steel cable secured to the mounting plate and an over-center latch pivotally secured to the binding plate. The over-center latch is configured to receive the steel cable and maintain locking engagement with the steel cable during operation of the sport board assembly. As an alternative, the lock may include a strap secured to the mounting board. The strap includes a first snap element attached to a distal end of the strap, with a mating snap element secured to the binding plate. Hence, when the snap elements are placed in mating engagement, the strap prevents rotational movement of the binding plate about one of the axes of rotation.

In a further alternative, a locking mechanism can be used which employs a lever to control a locking device. The lever is located within a recess on the top surface of the binding plate. A shaft extends from the lever through the top plate to one or more lever feet which are adapted to engage one or more hinge arms by pivoting into recesses under the hinge arms.

In an open position, the lever feet do not engage the hinge arms and the binding assembly is free to rotate about the first and second axes of rotation. When the lever is rotated to a locked position, the lever feet concurrently pivot on the shaft into the recesses in the hinge arms, thereby engaging the hinge arms. The binding assembly is thus unable to rotate, as the hinge arms are held in a position adjacent the binding plate. If a single lever foot is employed, a single hinge is engaged and the binding assembly is prevented from rotating in one direction. With the use of two lever feet, two of the hinge arms can be engaged, and the binding assembly can be prohibited from rotating altogether.

As a further alternative, a ski binding-type safety mechanism can be employed to prevent rotation of the binding assembly about the first and second axes of rotation. Any known type of ski binding mechanism can be used. In one embodiment, a rotating cam is employed. The rotating cam is secured to the board and is adapted to engage a lip on one end of the binding plate. The cam is held in place by pressure exerted on it from a spring-loaded pin. The spring-loaded pin holds the cam in one of two positions, open and home.

When in the open position, the cam is situated with a receiving orifice facing upward to receive the lip. Exerting a downward pressure on the lip into the receiving orifice causes the cam to rotate into the home position where the binding plate rests flat against the mounting plate. The binding plate is thus prevented from rotating until an upward force sufficient to overcome the pressure exerted by the spring is exerted, thereby releasing the cam from the home position.

It is preferred that the binding assembly be made of a stiff, light-weight material such as aircraft aluminum or certain suitable plastics.

Thus, it is an object of the present invention to provide an improved snow board binding assembly for use with a sport board, such as a snow board, which permits pivotal movement between the rider's boot and the board.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which:

FIG. 10 is a perspective view of an alternative embodiment in which a ski binding-type safety mechanism is utilized to selectively prevent rotation of the binding plate;

FIG. 11 is a side view of the ski binding-type safety mechanism of FIG. 10 shown in the engaged position and with a cowling removed to better view the safety mechanism;

FIG. 12 is a side view of the ski binding-type safety mechanism of FIG. 12 shown in the disengaged position.

DETAILED DESCRIPTION OF THE PREFERRED EMBODIMENTS

Figure 1:
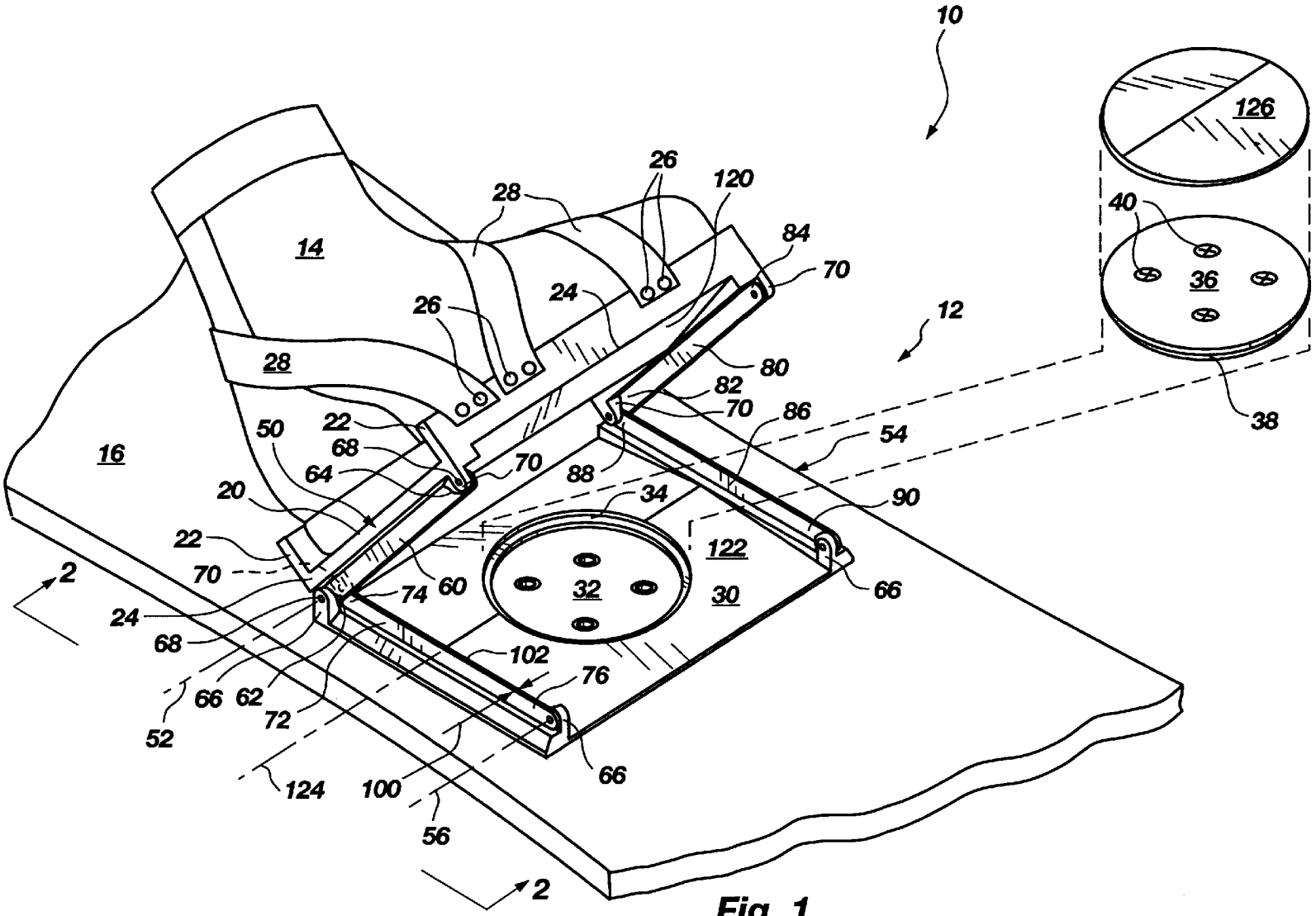
FIG. 1 is a perspective view of one presently preferred embodiment of the binding assembly of the present invention.

Reference is now made to the figures wherein like parts are referred to by like numerals throughout. With particular reference to FIG. 1, a sport board assembly according to the present invention is generally designated at 10. The assembly 10 includes a sport board to which is mounted a binding assembly 12 for securing a boot 14 of a rider to the sport board. In the embodiments depicted and described herein, the sport board comprises a snow board 16. The snow board 16 may include virtually any type of snow board, including those which are commercially available.

The binding assembly 12 includes a binding plate 20 which includes means for attachment of the binding plate 20 to the boot 14. In this embodiment, the attachment means includes a flange 22 extending upwardly from each lateral edge 24 of the binding plate 20. The flanges 22 include mounting holes 26 to which straps 28 may be secured. Straps 28 are configured to rigidly secure the boot 14 onto the binding plate 20. One of skill in the art will appreciate that a variety of attachment means may be utilized to effectively secure the boot 14 to the binding plate 20. For example, "step-in" binding systems and other quick-release binding systems may be readily employed in combination with the present invention.

The binding assembly 12 also includes a mounting plate 30 which includes means for attaching the mounting plate 30 to the board 16. The means for attaching the mounting plate 30 may also include any of a variety of commonly used mechanisms for attaching bindings to snow boards. One such mechanism involves configuring a circular mounting orifice 32 in the mounting plate 30. The orifice 32 has a recessed perimeter 34 for receiving a circular disk 36.

The disk 36 is similarly configured with a flange 38 which may matingly engage the recessed perimeter 34 of the mounting orifice 32. The disk 36 includes a plurality of screws 40 or other attachment means for securing the disk 36 to the board 16. Thus, when the disk 36 is positioned in the mounting orifice 32, the mounting plate 30 may be rotated about the disk 36 to an orientation preferred by the rider of the snow board 16. The screws 40 are then tightened, thereby preventing further rotational movement of the disk 36 relative to the mounting plate 30.

With continued reference to FIG. 1, the binding assembly 12 further comprises a first hinge assembly 50 capable of being secured in connection with the snow board 16. The first hinge assembly 50 is mounted to be in connection with the binding plate 20 to permit pivotal movement of the binding plate with respect to the snow board 16 about a first axis of rotation 52.

The binding assembly 12 also includes a second hinge assembly 54 which is capable of being secured in connection with the snow board 16. The second hinge assembly is also mounted in connection with the binding plate 20 to permit pivotal movement of the binding plate with respect to the snow board 16 about a second axis of rotation 56.

Figure 9:
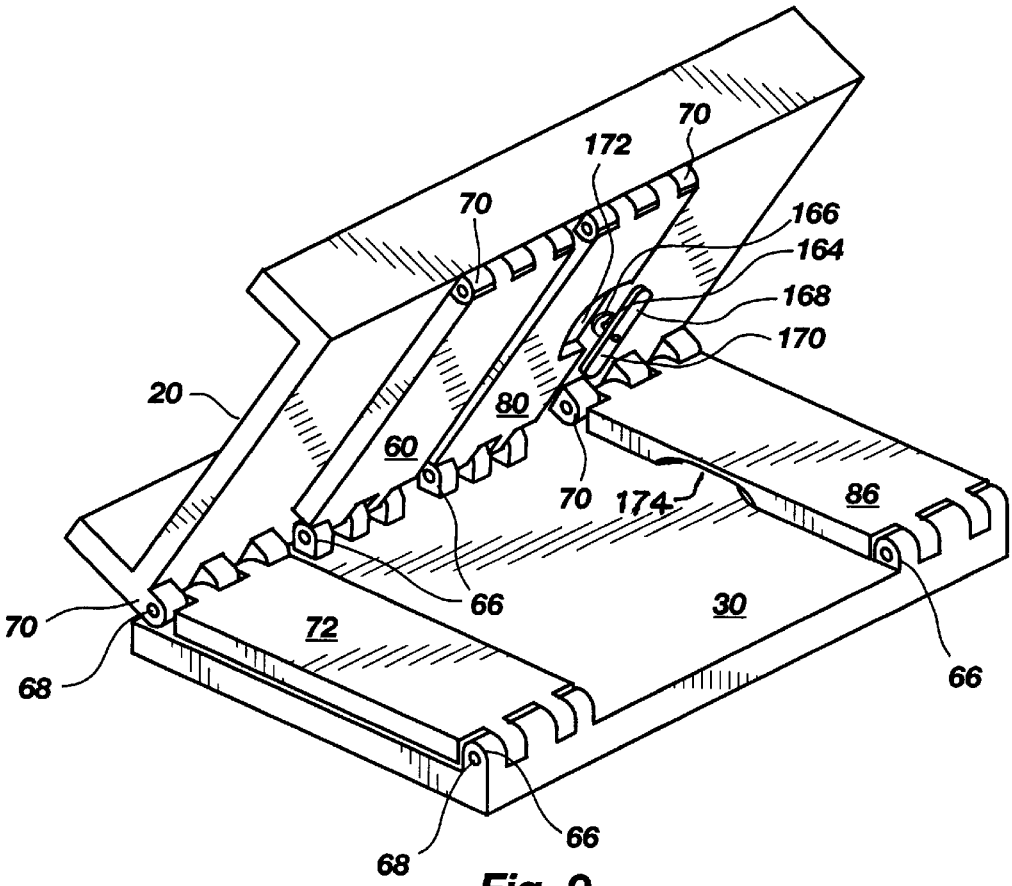
FIG. 9 is a perspective view taken from the left side showing lever feet attached by a shaft to the lever of FIG. 8.

As illustrated in FIG. 1 and also seen in FIG. 9, the first hinge assembly 50 includes a first hinge arm 60 having a first end 62 in pivotal connection with the snow board 16 about the first axis of rotation 52 and a second end 64 in pivotal connection with the binding plate 20 about the second axis of rotation 56. The first end 62 is placed in pivotal connection with the board 16 by securing it to one of a plurality of hinge mounts 66 configured in the mounting plate 30. As explained above, the mounting plate 30 is, in turn, secured to the board 16. A pin 68 secures the first hinge arm 60 to the hinge mount 66, thereby providing for rotational movement about the pin 68. Similarly, the second end 64 of the first hinge assembly 50 is placed in pivotal connection with the binding plate 20 by securing it with a pin 68 to one of a plurality of hinge mounts 70 configured on the binding plate 20.

In a similar fashion, the second hinge assembly 54 includes a first hinge arm 72 having a first end 74 capable of pivotal connection with the binding plate 20 about the first axis of rotation 52 and a second end 76 in pivotal connection with the board 16 about the second axis of rotation 56. This is achieved by pivotally mounting the first end 74 to a hinge mount 70 (shown in phantom lines) on the binding plate 20 and pivotally mounting the second end 76 to a hinge mount 66 configured in the mounting plate 30.

The first hinge assembly 50 also includes a second hinge arm 80 which has a first end 82 pivotally attached to a hinge mount 66 configured in the mounting plate 30 and a second end 84 pivotally attached to a hinge mount 70 configured in the binding plate 20. The second hinge assembly 54 additionally includes a second hinge arm 86 having a first end 88 pivotally attached to a hinge mount 70 configured in the binding plate 20 and a second end 90 pivotally attached to a hinge mount 66 configured in the mounting plate 30.

Figure 2:
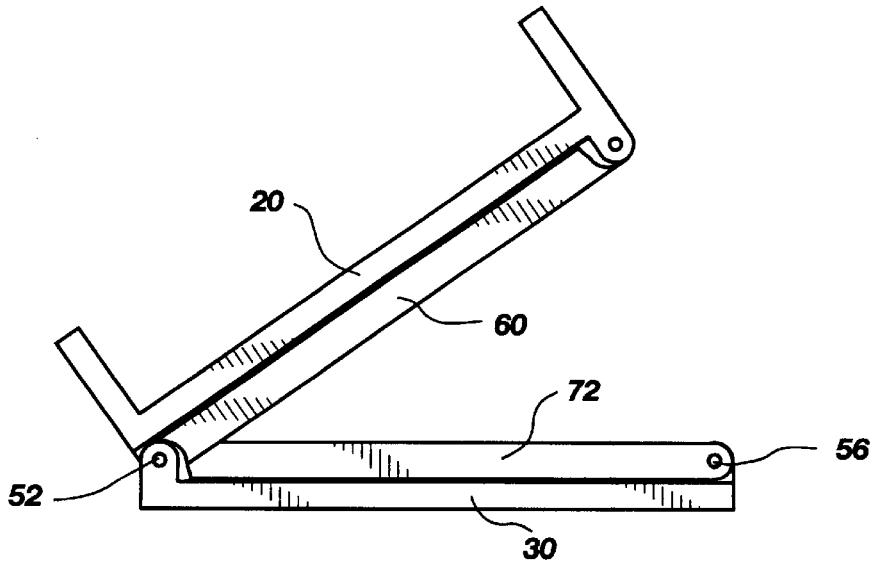
FIG. 2 is a rear plan view of the binding assembly of FIG. 1 with the binding plate in a first rotated position.
Figure 3:
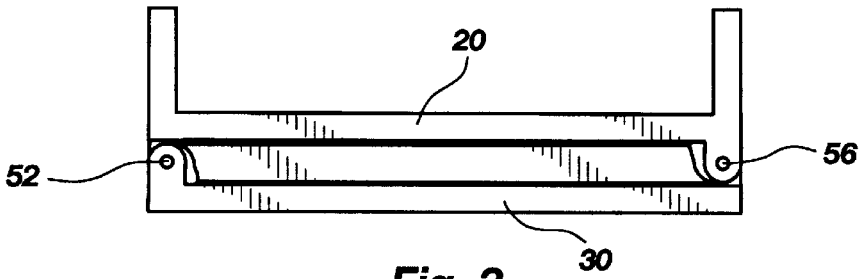
FIG. 3 is a rear plan view of the binding assembly of FIG. 1 with the binding plate in the home position.
Figure 4:
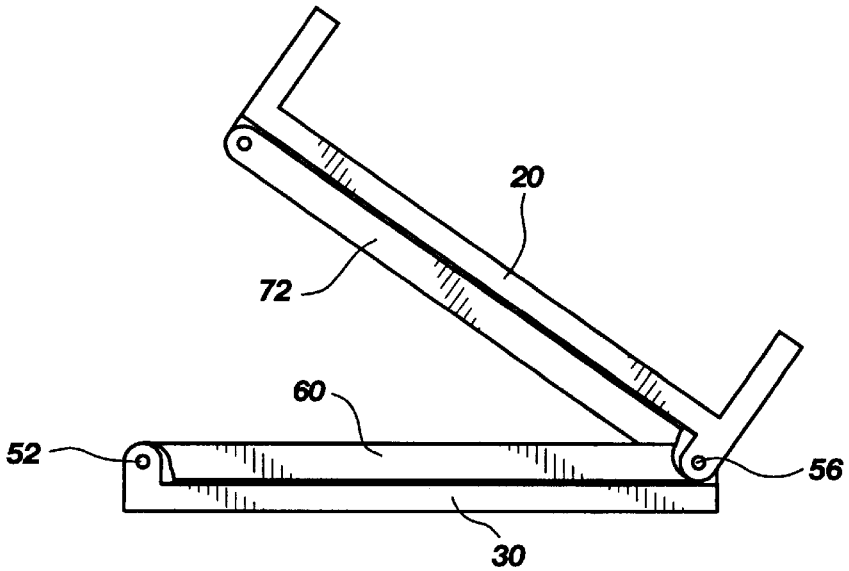
FIG. 4 is a rear plan view of the binding assembly of FIG. 1 with the binding plate in a second rotated position.

With reference now to FIGS. 2–4, the pivotal movement of the binding assembly 12 is illustrated in a rear plan view. With the first and second hinge assemblies configured as described above, the binding plate may rotate about the first axis of rotation 52 between a home position shown in FIG. 3 and a first rotated position shown in FIG. 2. The binding plate 20 is also permitted to pivot about the second axis of rotation 56 between the home position of FIG. 3 and a second rotated position shown in FIG. 4.

Advantageously, in this presently preferred embodiment, simultaneous upward movement of both ends of the binding plate 20 is not possible because only one of the first and second hinge assemblies 50 and 54 may move at one time. This is advantageous because any vertical movement of the boot is immediately translated to the board, thereby eliminating any response time associated with such movements.

When the binding plate 20 is in the home position as illustrated in FIG. 3, applying an upward force to the binding plate 20 will place all of the hinge arms in tension because the tendency of such a force is to elongate the hinge arms. No upward movement will result unless the force is such that pivotal movement about one (but not both) of the axes of rotation is possible. Thus, it will be appreciated that the hinge arms must be made of a material which will support a substantial tensile load with minimum elongation. Similarly, the binding plate must be capable of supporting a substantial compressive load.

Importantly, it is not necessary that the hinge arms be capable of supporting a load in compression. Thus, the hinge arms may also take the form of flexible straps or other materials capable of supporting a load only in tension.

While a number of materials such as steel, aluminum, titanium, magnesium, and graphite may be utilized, it is presently preferred that the hinge arms (and other elements of the binding assembly) be made of a plastic because plastics can be inexpensively injection molded to produce a work piece with good surface finish, high tolerances and low weight. Acetyl plastics are highly preferred because of their stiffness low friction and durability characteristics.

In the embodiments of FIG. 1 through FIG. 7, the binding plate, mounting plate, and hinge arms are made of aircraft aluminum. In the embodiments of FIGS. 9 through 12, the binding plate, mounting plate and hinge arms are made of a plastic such as polypropylene. Weight reduction techniques such as strategically places holes and recesses may also be used to further reduce weight.

Referring again to FIG. 1, the first axis of rotation 52 is defined by a collinear positioning of the pivotal axes of (a) the hinge arm 72 with respect to the binding plate 20, (b) the hinge arm 60 with respect to the mounting plate 30, (c) the hinge arm 80 with respect to the mounting plate 30, and (d) the hinge arm 86 with respect to the binding plate 20. The second axis of rotation 56 is similarly defined by the collinear position of the pivotal axes of (a) the hinge arm 60 with respect to the binding plate 20, (b) the hinge arm 72 with respect to the mounting plate 30, (c) the hinge arm 80 with respect to the binding plate 20, and (d) the hinge arm 86 with respect to the mounting plate 30.

Although not required, it is presently preferred that the first and second hinge assemblies 50, 54 be configured such that the first and second axes of rotation 52, 56 are substantially parallel to the plane of snow board 16 and to each other. It is also preferred that the first and second axes of rotation 52, 56 are substantially perpendicular to the length of the snow board 16. For some applications, however, it may be desirable to position the first axis of rotation at some predetermined angle to the second axis of rotation, thereby permitting the rider to rotate forward in one direction while being able to rotate reward in a different direction.

It is presently preferred that the first and second hinge assemblies 50, 54 be further configured such that the axes of rotation be positioned substantially collinearly with the lateral edges 24 of the binding plate. This configuration is preferred because it most accurately simulates the movement which many skateboarders prefer when performing tricks and other complicated maneuvers.

In an alternative embodiment, a single hinge arm, connected at one end to the mounting plate 30 and at another end to the binding plate 20, can be used to provide rotation about a first axis and about a second axis with rotation similar to the first axis of rotation 52 and the second axis of rotation 56. This embodiment is not preferred, as the hinge arm may tend to lift up rather than rotate about one axis or the other. The tendency to lift up can be somewhat overcome with the use of a pair of springs mounted appropriately to the hinge arm and to the mounting plate 30 or the binding plate 20, respectively.

The embodiment of the binding assembly 12 illustrated in FIG. 1 provides for the free rotation of the binding plate 20 about the axes of rotation 52, 56. However, in some circumstances it may be desirable to include modifications to provide resistance to rotation. For instance, springs can be attached to the hinge arms to provide an overcomeable resistance to rotation about one or both of the first and second axes of rotation 52, 56.

In a further embodiment, snaps or other mechanisms are utilized to provide for releasable engagement in securing the binding plate 20 to the mounting plate 30 until a force of a predetermined magnitude is applied to the binding plate 20. Upon the application of an appropriate force, the snaps would release and allow the binding plate 20 to freely rotate.

For some applications, it may be desirable to configure the binding assembly 12 to provide constant resistance to rotation about one or both axes of rotation. This can be done by providing an adjustable friction plate at the hinge mounts or by the utilization of other force resistant means which are well known in the art. Similarly, the binding assembly may be configured to provide non-linear resistance to rotation. This feature could be implemented, for example, through the utilization of adjustable torsion springs.

Some riders may prefer to limit the angle through which the binding plate 20 may rotate about one or both axes of rotation. In the illustrated embodiment, the maximum angle of rotation is about 90 degrees. However, the maximum angle of rotation may be limited to a lesser angle through the use of a non-elastic strap connecting one or both sides of the binding plate 20 to the mounting plate 30 or directly to the board 16. By using an adjustable strap, the user could easily adjust the maximum angle of rotation according to the user's personal preferences.

Whenever the binding plate 20 moves out of the home position (FIG. 3) to one of the rotated positions, the space between the binding plate 20 and the mounting plate 30 becomes exposed. When the binding plate 20 is in one of the rotated positions during operation, there exists the possibility of snow becoming lodged in that space and preventing the proper operation of the binding. The present invention includes a number of design features which address this possibility.

As illustrated in FIGS. 1 through 7, the hinge arms 60, 72, 80, 86 are, in one embodiment, configured so that their width 100 is minimized, thereby minimizing the size of the open surface 102 (the non-vertical surface which is exposed when the binding plate is in a rotated position) of the hinge arms. By minimizing the width 100 of the hinge arms, any force distributed over the open surface 102 of the hinge arms will give rise to a greater pressure. Thus, the likelihood that snow or other debris which became lodged in the path of the hinge arms would prevent the hinges from properly closing would be decreased. The hinge arms will generally have a width 100 less than about ten millimeters, with the width preferably being less than about three millimeters.

Additionally, the hinge assemblies are configured such that the first hinge arm 60 of the first hinge assembly 50 is substantially contiguous to the first hinge arm 72 of the second hinge assembly 54. Also, the second hinge arm 80 of the first hinge assembly 50 is preferably positioned substantially contiguous to the second hinge arm 86 of the second hinge assembly 54. Having the hinge arms contiguous to each other assists in preventing translational movement of the binding plate 20 relative to the mounting plate 30 in a direction moving parallel the axis of rotation by assisting in the transfer of forces in that direction through the hinge arms and to the board.

Figure 5:
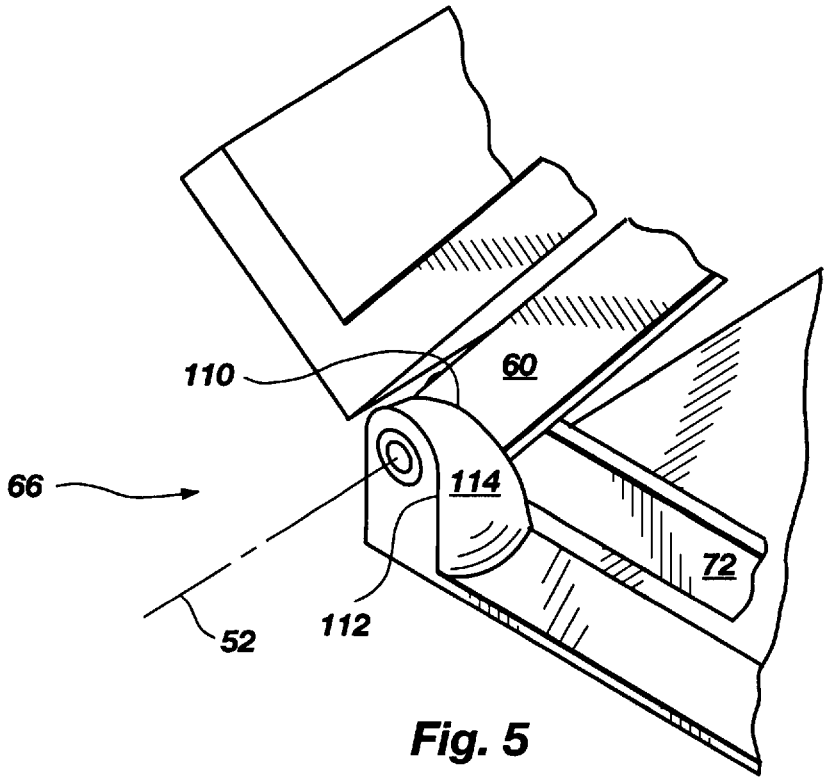
FIG. 5 is a perspective view of one presently preferred configuration of a hinge mount utilized in the binding of the present invention.

An additional design feature which is used in the embodiments of FIGS. 1 through 7 to prevent snow from interfering with the proper function of the binding is the configuration of the hinge mounts. This design feature is explained with reference to a hinge mount 66 configured in the mounting plate 30 to which the first end 62 of the first hinge arm 60 is pivotally secured, understanding that all of the hinge mounts 66, 70 are similarly configured. As illustrated in FIG. 5, the hinge mount 66 has a hinged side 110, adjacent the hinge arm 60 to which it is mounted, and an opposite, open side 112. The hinge mount 66 is contoured radially inwardly, toward the hinge axis (which coincides with the first axis 52), with the contour extending from the hinged side 110 toward the open side 112. Thus, any snow which accumulates around the hinge mount 66 will be forced down the face 114 of the contour, rather than having a flat surface against which to bear.

Referring again to the embodiment of FIG. 1, the bottom surface 120 of the binding plate 20 and the top surface 122 of the mounting plate 30 are positioned relative to each other and configured to prevent snow from interfering with the function of the binding. The bottom surface 120 of the binding plate is substantially contiguous to the top surface 122 of the mounting plate when the binding plate is in the home position (FIG. 3). Thus, when the binding plate moves from one of the rotated positions into the home position, any snow or other debris will be forced from between the binding plate and the mounting plate.

To facilitate the removal of snow in this manner, it is preferred that the bottom surface 120 of the binding plate 20 and the top surface 122 of the mounting plate 30 are made of a low-friction material. Suitable materials are high density polyethylene, Tefzel (a material sold by du Pont which includes Teflon), various nylon materials, with acetyl copolymer being preferred.

As illustrated in FIG. 1, the bottom surface 120 of the binding plate 20 is configured to incline upwardly from a centerline 124 extending generally parallel to the axes of rotation. The top surface 122 of the mounting plate 30 is correspondingly configured to incline downwardly from the centerline 124. Thus, a wedge is formed between the mounting plate 30 and the binding plate 20 which aids in forcing contaminants, such as snow, to be pushed out from between the binding plate 20 and the mounting plate 30 when the binding plate 20 is rotated from one of the rotated positions to the home position.

For binding configurations employing a mounting disk 36, such as that illustrated in FIG. 1, a cap 126 may be utilized to fit on top of the disk 36. The cap 126 thus provides the top surface configuration for the mounting plate 30 and is configured to correspond to the desired top surface configuration of the mounting plate 30. The cap may be press fit into the mounting orifice 32; alternatively, the cap may be secured in the mounting orifice 32 by any of a number of other attachment mechanisms known to those of skill in the art.

Figure 6:
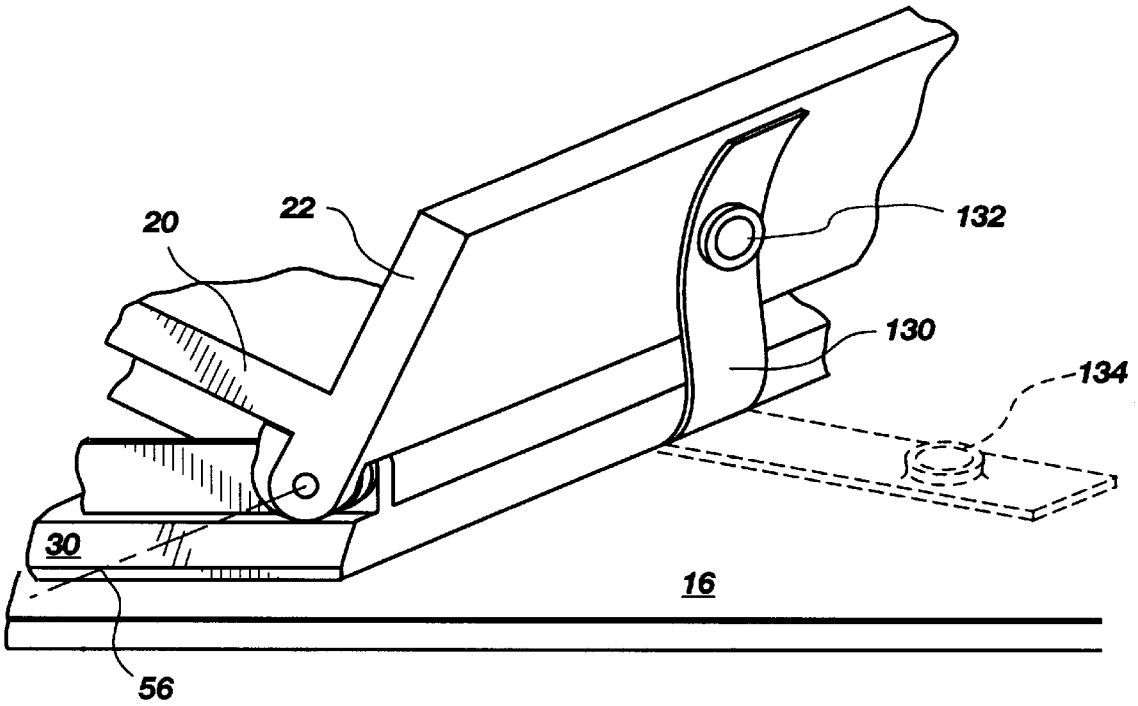
FIG. 6 is a perspective view of one embodiment of a lock utilized to selectively prevent rotation of the binding plate.

Another feature of the present invention is the provision of a lock which may be used to selectively prevent the binding plate from pivoting about one or both of the axes of rotation. One embodiment of such a lock is illustrated in FIG. 6. In this embodiment, the lock comprises a strap 130 secured in connection with the board 16. This may be done, for example, by securing the strap 130 between the mounting plate 30 and the board 16.

The strap includes a double-sided snap element 132 attached to a distal end of the strap. A mating snap element (not shown) is secured to the face of the flange 22 of the binding plate 20. Thus, when the snap elements are placed in mating engagement, the strap prevents rotational movement of the binding plate 20 about the first axis of rotation. A similar snap could be employed on the other side of the binding to prevent the binding plate 20 from rotating about the second axis of rotation 56. A mating snap element 134 may also be mounted on the board to provide means for securing the strap 130 when it is not attached to the binding plate 20.

Figure 7:
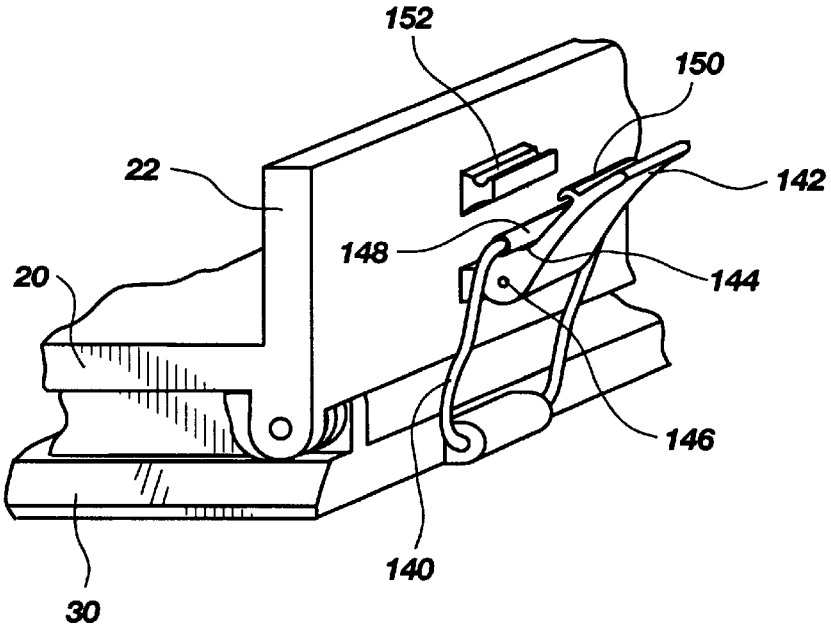
FIG. 7 is a perspective view of an alternative embodiment of a lock utilized to selectively prevent rotation of the binding plate.

An alternative embodiment of the lock is illustrated in FIG. 7. In this embodiment, a cable 140, such as any of those steel cables which are commercially available, is secured to the mounting plate or directly to the board. A latch 142, configured with a pocket 144 for receiving one end of the cable 140, is pivotally mounted to the side of the flange 22 about a pivot 146. The portion of the cable 140 which engages the pocket 144 in the latch 142 may comprise a steel bar 148 to facilitate its engagement with the pocket 144 and extend the wear of the cable 140.

With the steel bar 148 engaged in the pocket 144, the latch 142 may be rotated to its secured position (counterclockwise in FIG. 7) and secured against the flange 22 of the binding plate 20. A snap 150 may be provided on the distal end of the latch 142 and a corresponding snap groove 152 configured on the flange 22 to provide means for securing the latch against the flange.

Figure 8:
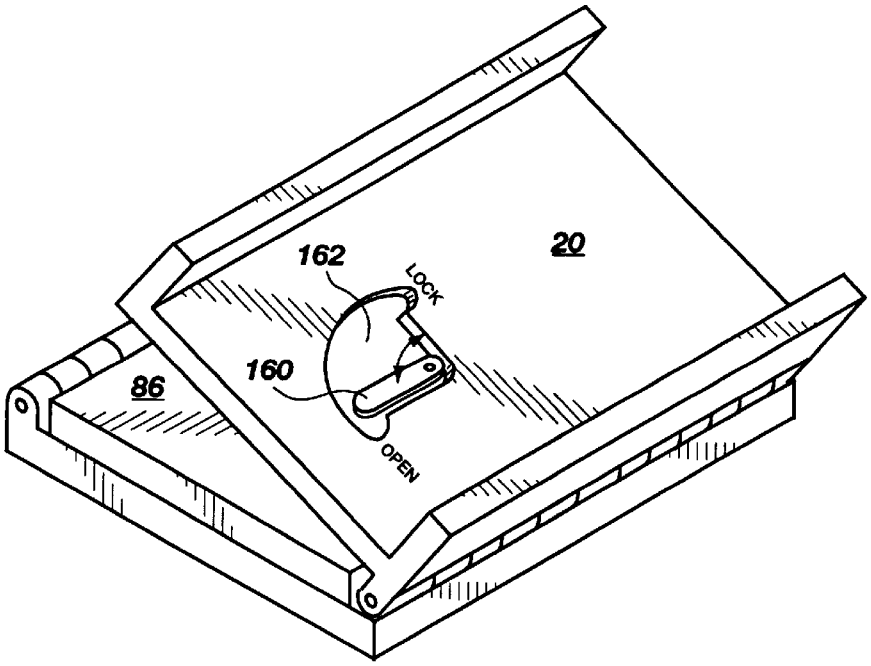
FIG. 8 is a perspective top view taken from the right side of an alternate embodiment of a lock utilized to selectively prevent rotation of the binding plate and shows a lever within a recess on the binding plate.

In another alternative embodiment, illustrated in FIG. 8, a locking mechanism is used to prevent rotational movement. In the depicted embodiment, the locking mechanism employs a lever 160 for selectively locking and unlocking the locking mechanism. The lever 160 is preferably located in a recess 162 at one end of the binding plate 20. The lever 160 rotates about a shaft 164 which extends from one end of the lever 160 through the binding plate 20. As shown in FIG. 9, a washer 166 beneath the binding plate 20 is used to hold the shaft 164 in place within the binding plate 20. One or more locking feet are attached to the bottom of the shaft 164 and are used to lock the binding plate 20 to the hinge arms in order to prevent rotational movement of the binding plate.

In the embodiment shown in FIG. 9, two locking feet—an upper locking foot 168 and a lower locking foot 170—are employed. In FIGS. 8 and 9, the lever is shown in the open position, and thus, the locking feet 168, 170 are disengaged from the hinge arms. Rotating the lever 160 counterclockwise to the locked position thereby rotates upper locking foot 168 into a recess 172 on the second hinge arm 80 of the first hinge assembly 50. Concurrently, the lower locking foot 170 is rotated within a recess 174 of the second hinge arm 86 of the second hinge assembly 54. In this locked position, the first hinge assembly 50 and the hinge arms 80 and 86 are retained in a position adjacent to the binding plate 20 which is prevented from any rotational movement.

In a further embodiment, only one of upper locking foot 168 and lower locking foot 170 is employed. In this manner, depending on which of upper locking foot 168 and lower locking foot 170 is used, the binding plate 20 is prevented from rotational movement along one of first axis of rotation 52 and second axis of rotation 56 of FIG. 1.

Additionally, for selective determination of rotational movement, two such locking mechanisms can be employed, one with a locking foot which locks under one of the hinge arms 60, 80 of the first hinge assembly 50, and one with a locking foot which locks under one of the hinge arms 72, 86 of the second hinge assembly 54.

As a further alternative, a safety mechanism can be utilized to prevent rotation of the binding assembly until released upon application of a predetermined force. FIG. 10 shows such a safety mechanism which employs a ski binding-type mechanism to prevent rotation about both of the first and second axes of rotation 52, 56. Any type of ski binding mechanism can be used as a safety mechanism, including those that are known in the art. In the embodiment shown, a rotating cam 184 is disposed in the mounting plate 30 and is used to releasably engage a lip 182 of the binding plate 20, as seen in FIG. 11. The cam 184 rotates about an axis of rotation defined by a pin 186 which extends through the cam 184 and secures the cam 184 to the mounting plate 30. A cowl 194 houses the cam 184 and protects the cam 184 from damage.

The cam 184 is held in detente by a spring-loaded pin 188. The spring-loaded pin 188 has a rounded end which protrudes into one of two indentations 198. In FIG. 11, the safety mechanism is in the engaged position with the spring-loaded pin 188 engaging the lower indentation 198. When sufficient force is applied to cam 184 through lip 182, cam 184 is allowed to rotate upward on the axis of rotation defined by pin 186 to the disengaged position shown in FIG. 12. As noted therein, the spring-loaded pin 188 is now engaging the upper of indentations 198. In this position, the receiving orifice 196 of the cam 184 is in position to receive the lip 182 when the binding plate 20 is pressed downward into the home position of FIG. 3.

Once released from the home position, a sufficient downward pressure exerted by pressing the lip 182 into the receiving orifice 196 causes the cam 184 to rotate downward into the home position. The binding assembly is thereby prevented from rotating until, once again, a sufficient amount of upward force is exerted to overcome the pressure exerted by the spring-loaded pin and release the binding assembly from the home position.

The amount of pressure necessary to release the cam 184 from the home position is, in the depicted embodiment, determined by threading the spring-loaded pin 188 into a slot 192. Threading the spring-loaded pin 188 further into the slot 192 compresses the spring 190, thereby creating a greater force to overcome in releasing the cam 184. Unthreading the spring-loaded pin 188 out of the slot 192 decompresses the spring 190 and reduces the upward force needed to release the cam 184 and thereby the binding assembly from the home position.

Figure 13:
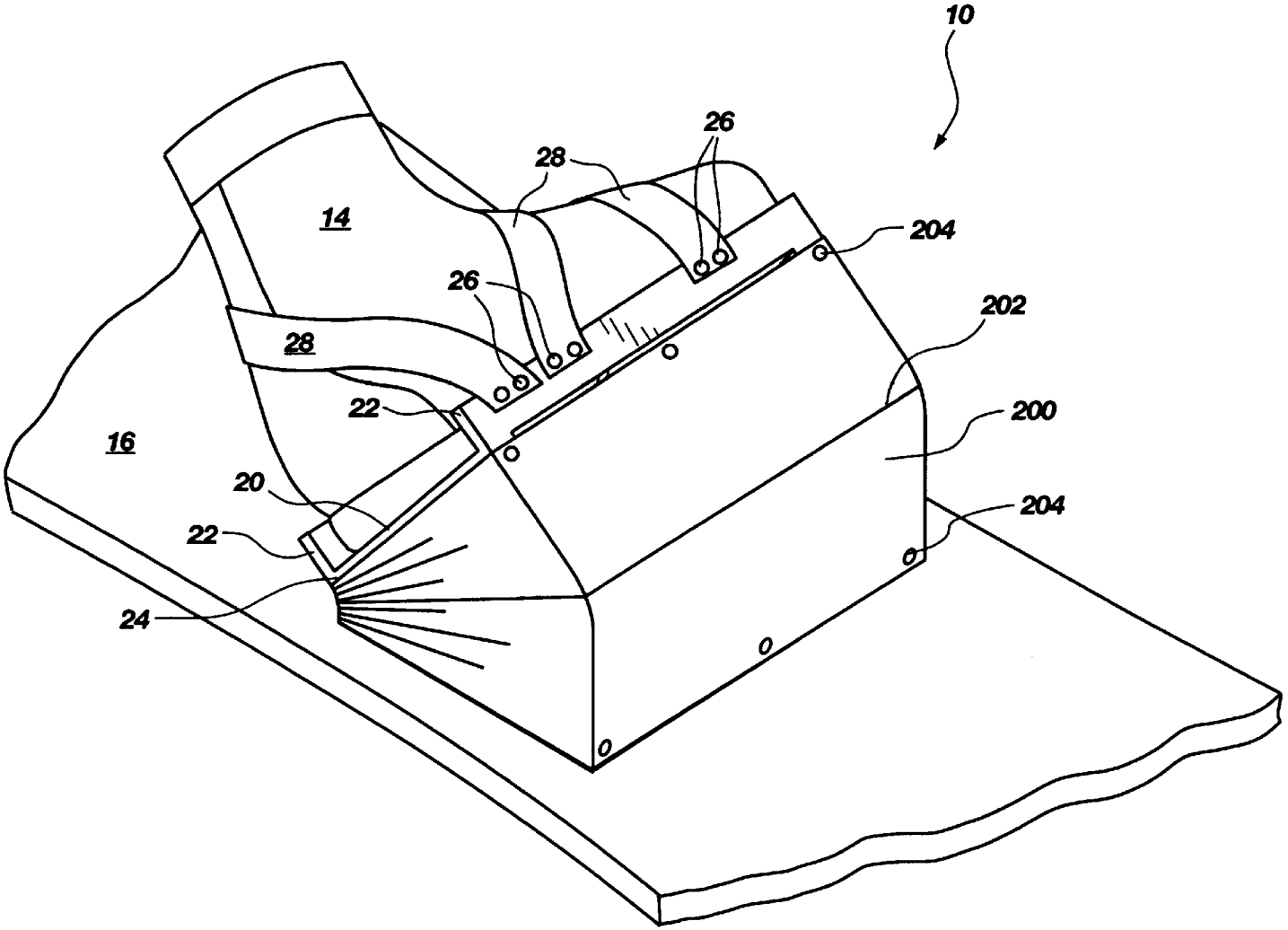
FIG. 13 is a perspective view of the binding assembly of FIG. 7 showing a protective covering over the binding assembly.

As an alternative to the configurations described above which operate to remove snow from between the binding plate and the mounting plate, means could also be provided for preventing snow from becoming lodged between the binding plate and the mounting plate. Such means may include, for example, the use of a protective covering 200, shown in FIG. 13, which is attached between the binding plate 20 and the mounting plate 30 and extends around the periphery of the mounting plate 30. The protective covering 200 may also extend up over the boot. Such a cover can be made of rubber, neoprene or other elastic materials that stretch during rotation and then snap back into shape. Non-flexible materials can also be used and are typically configured with bellows-type folds which allow the protective covering 200 to expand and contract. Reinforcing ribs (not shown) may also be sewn into the protective covering 200 to ensure that the protective covering 200 returns to its original shape after rotation and does not collapse between the binding plate 20 and the mounting plate 30. The cover may also include a zipper, snap or other closure mechanism to permit easy access to the binding mechanism while acting as a barrier to snow or other debris.

From the foregoing it will be appreciated that the present invention provides an advanced binding mechanism for use on a sport board which allows for pivotal movement of the rider's boot about axes of rotation substantially along the lateral edge of the boot. The present invention also provides an improved binding assembly which decreases the risk of injury in the event of a fall or collision while riding a sport board.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A binding for securing a boot to a sport board, comprising:

a binding plate including means for attachment of the binding plate to the boot;

a first hinge assembly capable of being secured in connection with the board and being in connection with the binding plate; and a second hinge assembly capable of being secured in connection with the board and being in connection with the binding plate, thereby permitting pivotal movement of the binding plate with respect to the board about a first axis of rotation between a home position, in which the binding plate is substantially coplanar with the board, and a first rotated position, and permitting pivotal movement of the binding plate with respect to the board about a second axis of rotation between the home position and a second rotated position, the first and second hinge assemblies each including at least one hinge arm and hinge pins connecting the at least one hinge arm to the binding plate and the board, said hinge pins defining pivot locations for the first and second axes of rotation, the first and second hinge assemblies further configured such that the first and second axes of rotation are substantially parallel to the plane of the board, thereby allowing selective pivotal movement of the binding plate with respect to the sport board about the first or second axis of rotation.

2. A binding as defined in claim 1, wherein the binding plate has two lateral edges and wherein the first and second hinge assemblies are configured such that the first axis of rotation is substantially collinear with one of the lateral edges of the binding plate and the second axis of rotation is substantially collinear with the other of the lateral edges of the binding plate.

3. A binding as defined in claim 1, wherein the first and second hinge assemblies are further configured such that the first axis of rotation is substantially parallel to the second axis of rotation.

4. A binding for securing a boot to a sport board, comprising:

a binding plate including means for attachment of the binding plate to the boot;

a first hinge assembly capable of being secured in connection with the board and being in connection with the binding plate; and a second hinge assembly capable of being secured in connection with the board and being in connection with the binding plate, thereby permitting pivotal movement of the binding plate with respect to the board about a first axis of rotation between a home position, in which the binding plate is substantially coplanar with the board, and a first rotated position, and permitting pivotal movement of the binding plate with respect to the board about a second axis of rotation between the home position and a second rotated position, wherein the first hinge assembly includes a first hinge arm having a first end capable of pivotal connection with the board about the first axis of rotation and a second end in pivotal connection with the binding plate about the second axis of rotation, and wherein the second hinge assembly includes first hinge arm having a first end in pivotal connection with the binding plate about the first axis of rotation and a second end capable of pivotal connection with the board about the second axis of rotation, the first and second hinge assemblies further configured such that the first and second axes of rotation are substantially parallel to the plane of the board.

5. A binding as defined in claim 4, wherein the binding plate has two lateral edges and wherein the first and second hinge assemblies are configured such that the first axis of rotation is substantially collinear with one of the lateral edges of the binding plate and the second axis of rotation is substantially collinear with the other of the lateral edges of the binding plate.

6. A binding as defined in claim 4, wherein the first and second hinge assemblies are further configured such that the first axis of rotation is substantially parallel to the second axis of rotation.

7. A binding as defined in claim 4, wherein the first hinge assembly further includes a second hinge arm having a first end capable of pivotal connection with the board about the first axis of rotation and a second end in pivotal connection with the binding plate about the second axis of rotation, and wherein the second hinge assembly includes a second hinge arm having a first end in pivotal connection with the binding plate about the first axis of rotation and a second end capable of pivotal connection with the board about the second axis of rotation.

8. A binding as defined in claim 4, further comprising a mounting plate capable of attachment to the board, and wherein the first end of the first hinge arm of the first hinge assembly and the second end of the first hinge arm of the second hinge assembly are pivotally mounted to the mounting plate.

9. A binding assembly as defined in claim 8, further comprising:

a lever disposed within a recess in an upper surface of the binding plate;

a locking foot disposed between the binding plate and the sport board;

a shaft connecting the lever and the locking foot and extending through the mounting plate; and a recess within one of the hinge arms of the first and second hinge assemblies, the lever having a locked position and an open position, whereby when in the locked position the locking foot protrudes into the recess thereby preventing rotation of the binding plate along at least one of the axes of rotation, and when in the open position the locking foot is free of engagement of the recess.

10. A binding assembly as defined in claim 8, further comprising a safety mechanism which prevents the binding plate from pivoting about at least one of the axes of rotation until a predetermined upward force is exerted on the binding plate, the safety mechanism comprising:

a lip connected to the binding plate; and a cam connected to the sport board, the cam having a receiving orifice for engaging the lip, the cam being spring loaded and rotatable between an open position and a home position, such that when in the home position, the lip is received within the receiving orifice and prevents the binding plate from moving from the home position until a predetermined upward force is exerted on the binding plate, and when in the open position, a downward force of the lip on the cam causes the cam to rotate into the home position.

11. A binding assembly as defined in claim 8, further comprising a protective covering extending between the binding plate and the mounting plate and substantially circumscribing the binding plate and the mounting plate.

12. A sport board assembly which may be secured to the boot of a rider, comprising:

a sport board;

a binding plate including means for attachment of the binding plate to the boot;

a first hinge assembly including a first hinge arm having a first end in pivotal connection with the board about a first axis of rotation and a second end in pivotal connection with the binding plate about a second axis of rotation; and a second hinge assembly including a first hinge arm having a first end in pivotal connection with the binding plate about the first axis of rotation and a second end in pivotal connection with the board about the second axis of rotation, thereby permitting the binding plate to pivot about the first axis of rotation between a home position and a first rotated position and permitting the binding plate to pivot about the second axis of rotation between the home position and a second rotated position, the first and second hinge assemblies further configured such that the first and second axes of rotation are substantially parallel to each other and to the plane of the board.

13. A sport board assembly as defined in claim 12, wherein the first hinge assembly further includes a second hinge arm having a first end in pivotal connection with the board about the first axis of rotation and a second end in pivotal connection with the binding plate about the second axis of rotation and wherein the second hinge assembly includes a second hinge arm having a first end in pivotal connection with the binding plate about the first axis of rotation and a second end in pivotal connection with the board about the second axis of rotation.

14. A sport board assembly as defined in claim 12, wherein the hinge arms have a width less than about ten millimeters.

15. A sport board assembly as defined in claim 12, further comprising a mounting plate including means for attaching the mounting plate to the board, and wherein the first end of the first hinge arm of the first hinge assembly and the second end of the first hinge arm of the second hinge assembly are pivotally mounted to the mounting plate.

16. A sport board assembly as defined in claim 15, wherein the binding plate has a bottom surface and the mounting plate has a top surface, wherein the bottom surface of the binding plate is substantially contiguous to the top surface of the mounting plate when the binding plate is in the home position, and wherein the bottom surface of the binding plate and the top surface of the mounting plate are made of acetyl copolymer.

17. A sport board assembly as defined in claim 12, wherein the binding plate has two lateral edges and wherein the first and second hinge assemblies are configured such that the first axis of rotation is substantially collinear with one of the lateral edges of the binding plate and the second axis of rotation is substantially collinear with the other of the lateral edges of the binding plate.

18. A sport board assembly as defined in claim 12, further comprising a lock configured to prevent the binding plate from pivoting about at least one of the axes of rotation.

19. A sport board assembly as defined in claim 12, further comprising:

a lever disposed within a recess in an upper surface of the binding plate;

a locking foot disposed between the binding plate and the sport board;

a shaft connecting the lever and the locking foot and extending through the mounting plate; and a recess within one of the hinge arms of the first and second hinge assemblies, the lever having a locked position and an open position, whereby when in the locked position the locking foot protrudes into the recess thereby preventing rotation of the binding plate along at least one of the axes of rotation, and when in the open position the locking foot is free of engagement of the recess.

20. A sport board assembly as defined in claim 12, further comprising a safety mechanism which prevents the binding plate from pivoting about at least one of the axes of rotation until a predetermined upward force is exerted on the binding plate, the safety mechanism comprising:

a lip connected to the binding plate; and a cam connected to the sport board, the cam having a receiving orifice for engaging the lip, the cam being spring loaded and rotatable between an open position and a home position, such that when in the home position, the lip is received within the receiving orifice and prevents the binding plate from moving from the home position until a predetermined upward force is exerted on the binding plate, and when in the open position, a downward force of the lip on the cam causes the cam to rotate into the home position.

21. A sport board assembly as defined in claim 12, further comprising a protective covering extending between the binding plate and the mounting plate and substantially circumscribing the binding plate and the mounting plate.

22. A sport board assembly which may be secured to the boot of a rider, comprising:

a sport board;

a binding plate including means for attachment of the binding plate to the boot;

a mounting plate including means for attachment of the mounting plate to the board;

a first hinge assembly including a first hinge arm and a second hinge arm, the first hinge arm having a first end pivotally mounted about a first axis of rotation to the mounting plate and a second end pivotally mounted about a second axis of rotation to the binding plate, the second hinge arm having a first end pivotally mounted about the first axis of rotation to the mounting plate and a second end pivotally mounted about the second axis of rotation to the binding plate; and a second hinge assembly including a first hinge arm and a second hinge arm, the first hinge arm having a first end pivotally mounted about the first axis of rotation to the binding plate and a second end pivotally mounted about the second axis of rotation to the mounting plate, the second hinge arm of the second hinge assembly having a first end pivotally mounted about the first axis of rotation to the binding plate and a second end pivotally mounted about the second axis of rotation to the mounting plate, thereby permitting the binding plate to pivot about the first axis of rotation between a home position and a first rotated position and permitting the binding plate to pivot about the second axis of rotation between the home position and a second rotated position, the first and second hinge assemblies further configured such that the first and second axes of rotation are substantially parallel to each other and to the plane of the board.

23. A sport board assembly as defined in claim 22, wherein the hinge arms have a width less than about ten millimeters.

24. A sport board assembly as defined in claim 22, wherein the hinge arms have a width less than about three millimeters.

25. A sport board assembly as defined in claim 22, wherein the binding plate has a bottom surface and the mounting plate has a top surface, wherein the bottom surface of the binding plate is substantially contiguous to the top surface of the mounting plate when the binding plate is in the home position, and wherein the bottom surface of the binding plate and the top surface of the mounting plate are made of a low-friction material.

26. A sport board assembly as defined in claim 25, wherein the bottom surface of the binding plate and the top surface of the mounting plate are made of acetyl copolymer.

27. A sport board assembly as defined in claim 25, wherein the bottom surface of the binding plate and the top surface of the mounting plate are made of a high density polyethylene.

28. A sport board assembly as defined in claim 25, wherein the bottom surface of the binding plate and the top surface of the mounting plate are made of a material including TEFLON.

29. A sport board assembly as defined in claim 25, wherein the bottom surface of the binding plate and the top surface of the mounting plate are made of nylon.

30. A sport board assembly as defined in claim 22, wherein the binding plate has a bottom surface and the mounting plate has a top surface, the bottom surface of the binding plate configured to incline upwardly from a centerline extending generally parallel to at least one of the axes of rotation, the top surface of the mounting plate configured to incline downwardly from the centerline, thereby forming a wedge between the mounting plate and the binding plate and forcing contaminants, such as snow, to be pushed out from between the binding plate and the mounting plate when the binding plate is rotated from one of the rotated positions to the home position.

31. A sport board assembly as defined in claim 30, wherein the means for attaching the mounting plate to the board comprises a circular disk having a perimeter configured with a flange and a mounting orifice configured in the mounting plate, the mounting orifice having a recessed perimeter for receiving the flange of the circular disk, the circular disk and the mounting orifice configured such that when the disk is mounted to the board, rotational movement of the disk relative to the mounting plate is prevented, and further comprising a cap securable in the mounting orifice to cover the circular disk.

32. A sport board assembly as defined in claim 22, wherein the first and second hinge assemblies further comprise hinge mounts configured in the mounting plate and the binding plate, the hinge mounts configured for pivotal attachment to the ends of the hinge arms, the hinge mounts positioned such that when the binding plate is in the home position the first hinge arm of the first hinge assembly is substantially contiguous to the first hinge arm of the second hinge assembly, and the second hinge arm of the first hinge assembly is substantially contiguous to the second hinge arm of the second hinge assembly.

33. A sport board assembly as defined in claim 32, wherein each hinge mount has a hinged side adjacent the hinge arm to which it is mounted and an opposite, open side, and wherein each hinge mount is contoured radially inwardly, toward the hinge axis, the contour extending from the hinged side toward the open side.

34. A sport board assembly as defined in claim 22, further comprising a lock configured to prevent the binding plate from pivoting about at least one of the axes of rotation.

35. A sport board assembly as defined in claim 34, wherein the lock comprises a steel cable secured to the mounting plate and an over-center latch pivotally secured to the binding plate, the over-center latch configured to receive the steel cable and maintain locking engagement with the steel cable during operation of,the sport board assembly.

36. A sport board assembly as defined in claim 34, wherein the lock comprises a strap secured to the mounting board, the strap including a first snap element attached to a distal end of the strap, with a mating snap element secured to the binding plate, such that when the snaps are placed in mating engagement, the strap prevents rotational movement of the binding plate about one of the axes of rotation.

37. A sport board assembly as defined in claim 22, further comprising:

a lever disposed within a recess in an upper surface of the binding plate;

a locking foot disposed between the binding plate and the sport board;

a shaft connecting the lever and the locking foot and extending through the mounting plate; and a recess within one of the hinge arms of the first and second hinge assemblies, the lever having a locked position and an open position, whereby when in the locked position the locking foot protrudes into the recess thereby preventing rotation of the binding plate along at least one of the axes of rotation, and when in the open position the locking foot is free of engagement of the recess.

38. A sport board assembly as defined in claim 22, further comprising a safety mechanism which prevents the binding plate from pivoting about at least one of the axes of rotation until a predetermined upward force is exerted on the binding plate, the safety mechanism comprising:

a lip connected to the binding plate; and a cam connected to the sport board, the cam having a receiving orifice for engaging the lip, the cam being spring loaded and rotatable between an open position and a home position, such that when in the home position, the lip is received within the receiving orifice and prevents the binding plate from moving from the home position until a predetermined upward force is exerted on the binding plate, and when in the open position, a downward force of the lip on the cam causes the cam to rotate into the home position.

39. A sport board assembly as defined in claim 22, further comprising a protective covering extending between the binding plate and the mounting plate and substantially circumscribing the binding plate and the mounting plate.

* * * * *